US005829681A

United States Patent [19]

Hamel et al.

[11] Patent Number: 5,829,681

[45] Date of Patent: Nov. 3, 1998

[54] SPRAY GUN WITH DOUBLE TRIGGER LEVERS FOR DISPENSING TWO LIQUIDS INDEPENDENTLY OR IN ADMIXTURE

[75] Inventors: Jean-François Hamel, Otterburn Park; Louis Morisset, Saint-Augustin-de-Desmaures; Alain Gauthier, Lac-Beauport; Hubert Gagnon, Saint-Augustin-de-Desmaures; Marc Jacques; Bernard Juneau, both of Quebec; Marc Bouchard, Lauzon; Dominique Roy, Quebec; Guy Tremblay, Sainte-Foy; Bertrand Grégoire, St-Luc, all of Canada

[73] Assignee: Gilles Gregoire et Fils Inc., St-Hyacinthe, Canada

[21] Appl. No.: 748,152

[22] Filed: Nov. 12, 1996

[30] Foreign Application Priority Data

Nov. 5, 1996 [CA] Canada ..... 2189626

[51] Int. Cl.[6] ..... B05B 7/02; B05B 9/01

[52] U.S. Cl. ..... 239/304; 239/413; 239/526

[58] Field of Search ..... 239/304, 305, 239/407, 413, 526

[56] References Cited

U.S. PATENT DOCUMENTS 4,915,304 4/1990 Campani ..... 239/526 X

FOREIGN PATENT DOCUMENTS 1013551 8/1957 Germany ..... 239/526
1678393 9/1991 U.S.S.R. ..... 239/526

*Primary Examiner*—Lesley D. Morris
*Attorney, Agent, or Firm*—Swabey Ogilvy Renault; Paul Marcoux

[57] ABSTRACT

A spray gun for dispensing two liquids under pressure independently from one another or both simultaneously to form a mixture. The spray gun has a barrel in which are independently displaced two valves which are each spring biased to a closed position. A pair of trigger levers are pivotally secured to a single handle of the spray gun and independently or simultaneously actuable by the fingers of a single hand of the user person whereby to dispense two fluids independently or simultaneously. The valves are mounted coaxially within one another within the barrel of the gun. The valve assembly is easily removed from the barrel of the gun to facilitate servicing and assembly.

11 Claims, 6 Drawing Sheets

SPRAY GUN WITH DOUBLE TRIGGER LEVERS FOR DISPENSING TWO LIQUIDS INDEPENDENTLY OR IN ADMIXTURE

TECHNICAL FIELD

The present invention relates to a spray gun for dispensing two liquids under pressure independently from one another or both simultaneously to form a mixture. Preferably, but not exclusively, the gun is utilized as a gardening spray gun for dispensing chemical liquids such as liquid fertilizer and a pesticide solution under pressure.

BACKGROUND ART

There are a multitude of spray guns or dosage guns on the market for spraying chemicals, such as paint, pesticides, and the latter in admixture with water. A disadvantage of such spray guns is that they are complex in construction, expensive, difficult to assemble and repair and often prove unreliable in providing proper mixing of two liquids or more. Some of these guns also require two handles to operate two liquids independently and accordingly, the user does not have a free hand to perform another function while using the spray gun. Furthermore, when actuating two independent triggers, it may become confusing to the user as to what chemical is associated with each of the triggers when operated independently. When repair of a spray gun is necessitated, it is often necessary to return the spray gun to the manufacturer due to the complex construction of the gun mechanism.

SUMMARY OF INVENTION

It is therefore a feature of the present invention to provide a spray gun which substantially overcomes the above-mentioned disadvantages of the prior art and which is inexpensive, simple to operate, assemble and repair.

Another feature of the present invention is to provide a spray gun which is provided with independent valves mounted in a nozzle, with each valve being operated by an associated trigger lever pivotally connected within a single handle of the gun and operated by the fingers of a single hand of the user.

According to the above features, from a broad aspect, the present invention provides a spray gun for dispensing a first and a second liquid under pressure independently from one another or both simultaneously to form a spray mixture. The spray gun assembly has a barrel and a spray nozzle is provided in front of the barrel for receiving liquid from an outlet of the barrel and dispensing same in a jet spray. A handle forms part of the assembly. A first valve is sealingly displaceable in the barrel. First spring biasing means urges the first valve against a first valve seat to close a first feed conduit orifice communicating with the barrel. A first trigger lever is coupled to the first valve to displace same against the first spring biasing means to open the first feed conduit orifice and communicate same with the outlet of the barrel to release the first liquid under pressure through the spray nozzle. The first valve has passage means therein communicating with the outlet of the barrel. A second valve is sealingly displaceable in the passage means. Second spring biasing means urges the second valve against a second valve seat to close a second feed conduit orifice communicating with the passage means. A second trigger lever is coupled to the second valve to displace same against the second spring biasing means to open the second feed conduit orifice and communicate same with the passage means and the outlet of the barrel to release the second liquid under pressure through the spray nozzle. The first and second trigger levers are pivotally secured forwardly of the handle for actuation by the fingers of a single hand of a user person.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 1:
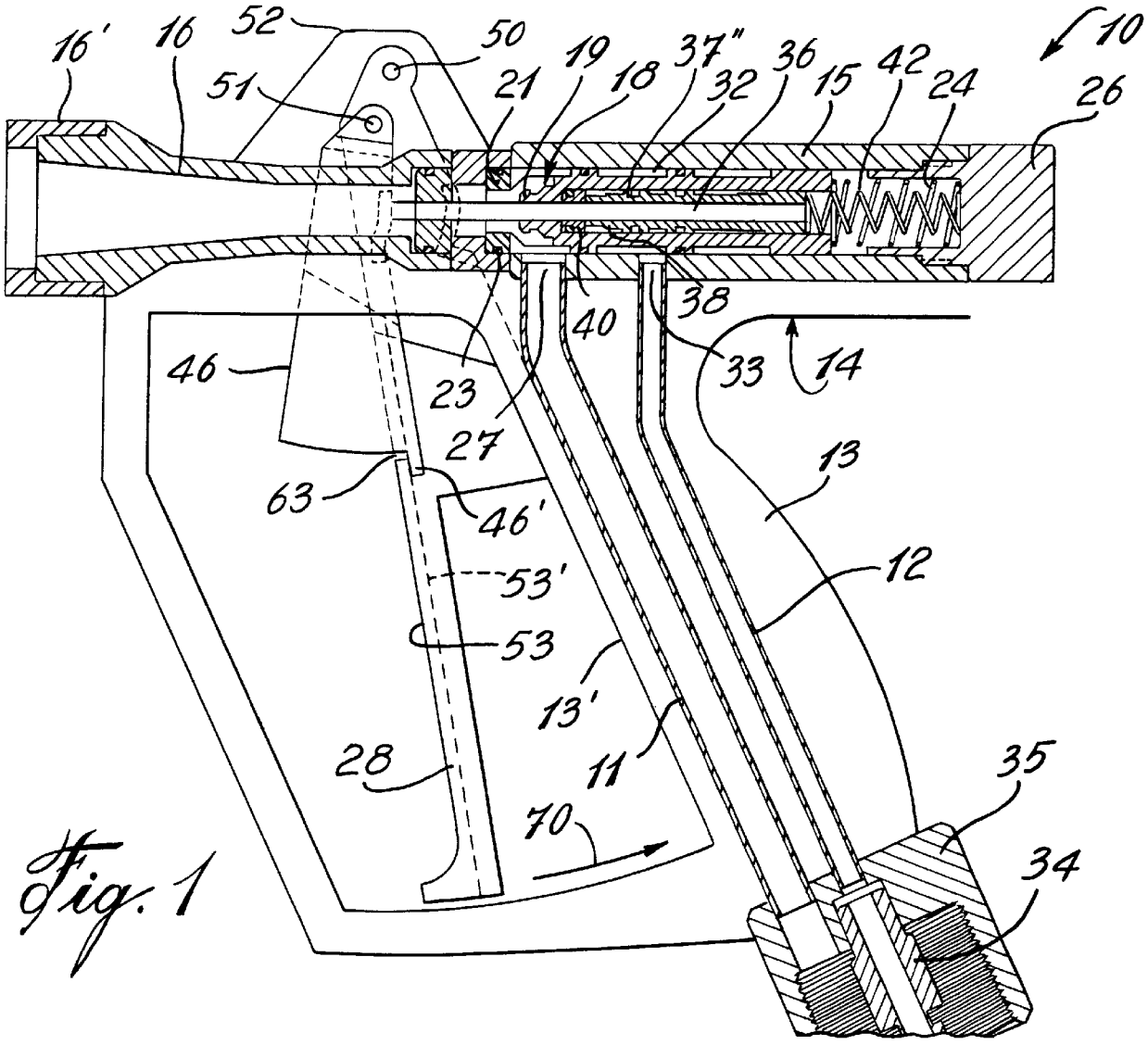
FIG. 1 is a fragmented side view showing the construction of the spray gun of the present invention.
Figure 2:
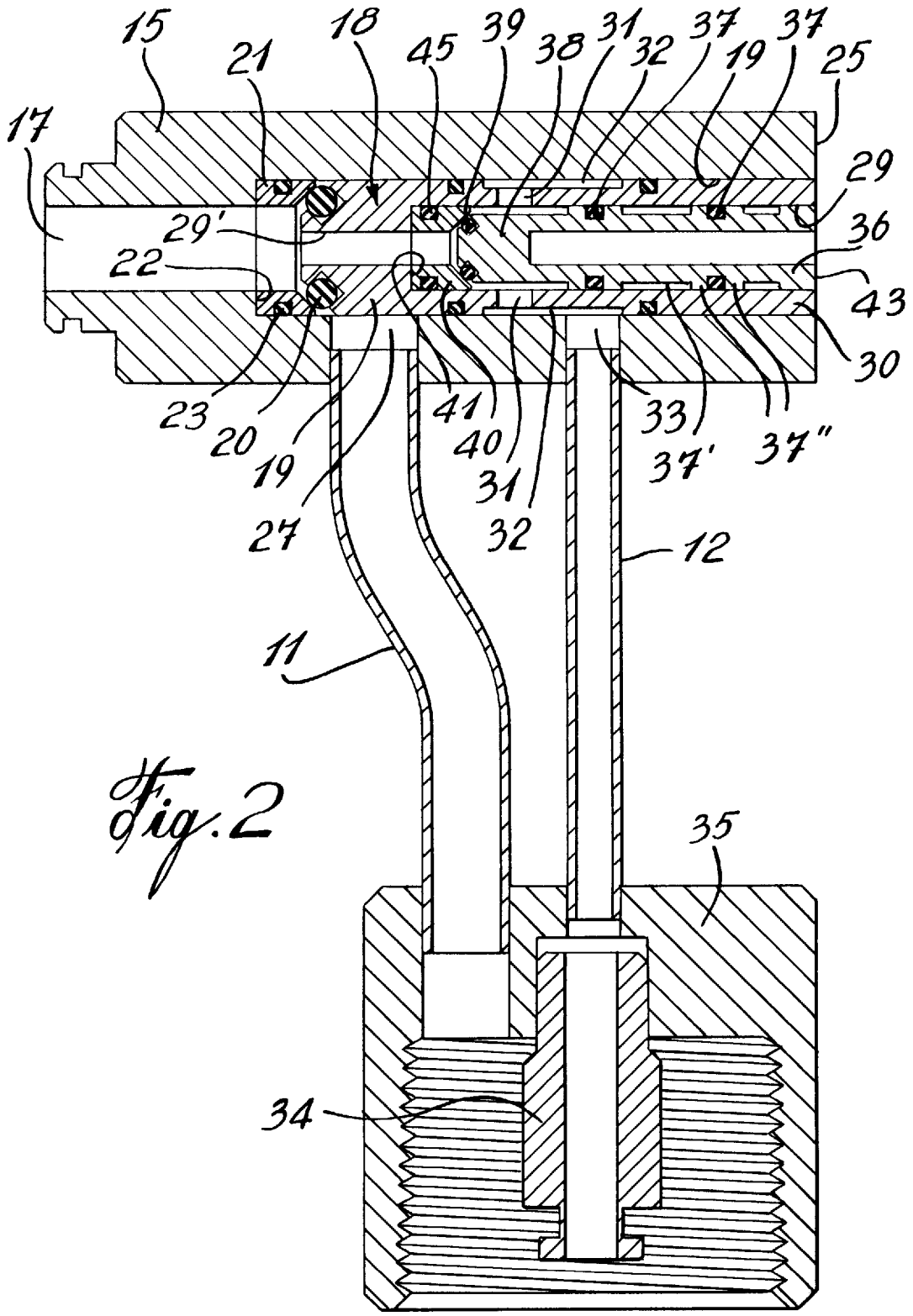
FIG. 2 is a section view illustrating the construction of the axially mounted valves secured inside the barrel of the spray gun and the conduit connections associated with each of the valves.

Referring now to the drawings and more particularly to FIGS. 1 to 3, there is shown generally at 10 the spray gun of the present invention, and herein a gardening spray gun for dispensing a first and second liquid under pressure which are connected to the conduits 11 and 12 which extends within the handle 13 of the spray gun assembly 14. A barrel 15 forms part of the spray gun assembly and a spray nozzle 16 is secured forwardly of an outlet 17 of the barrel 15 for dispensing liquid received therefrom in a jet spray. The jet spray may be adjustable by a control ring 16'.

As better seen in FIGS. 2 and 3, a first valve 18 in the form of an elongated cylindrical tubular member is sealingly displaceable inside the elongated tubular bore 19 of the barrel 15. The valve 18 has a head 19' provided with an O-ring seal 20 and is displaceable against a valve seat formed by an annular sealing ring 21 which is disposed inside the tubular bore 19 and in abutment with a forward arresting edge 22 of the bore. A further O-ring 23 provides a seal and retention of the annular ring 21 against the tubular bore 19'. The head 19 of the first valve 18 is spring biased against the annular ring 21 by a first spring biasing means constituted by a helical spring 24 which is retained captive and in compression between a rear wall 25 of the valve 18 and an end wall of a rear connecting cap 26 secured to a rear end of the barrel 15.

As is more clearly illustrated in FIG. 2, the valve 18 is urged against the valve seat or the annular ring 21 by the spring 24 whereby to close a first feed conduit orifice 27 in the barrel 15 and which is in communication with the elongated tubular bore 19 of the barrel 15 when the valve 18 is retracted. A first liquid under pressure, herein a fertilizer liquid, is connected to the orifice 27 via conduit 11. A first trigger lever 28 is coupled to the first valve 18, as will be described later, whereby to axially displace the first valve within the tubular bore 19 rearwardly of the first orifice 27 whereby to open the first feed conduit orifice 27 and communicate same with the tubular bore 19 and hence the outlet 17 of the barrel whereby to release the first liquid under pressure through the spray nozzle 16.

The valve 18 is an elongated cylindrical tubular member provided with an inner passage 29 which is of circular cross-section. The tubular member or valve 18 has a cylindrical wall 30 which is provided with an opening 31 therein and communicating through a circumferential gap 32, formed in an outer surface of the cylindrical wall 30, with a second orifice 33 in the barrel 15 and which is connected to the second feed conduit 12 through which is supplied a second fluid under pressure, herein a pesticide solution. Ring seals 32' are provided about the valve 18 on each side of the gap 32. A coupling 34 is connected to the second conduit whereby to receive a hose (not shown) which is connected to a supply source of this second fluid under pressure. This coupling 34 is secured within a screw-type connector 35 which secures to another hose or container (not shown) having the first liquid under pressure to supply the feed conduit 11 and independently of the other feed conduit 12.

A second valve 36 in the form of a rod-like member is axially displaceable in sealing engagement inside the passage 29 of the first valve 18. The rod-like member or second valve 36 is provided with two or more ring seals 37 about its periphery to provide a seal with the inner surface of the passage 29. A circumferential gap 37' is defined between the seals 37 for receiving the connecting head 60' of a rod connecting member, as will be described later.

The second valve 36 is also provided with a head 38 having a ring seal 39 which is positioned for abutment with a further valve seat or annular ring 40 mounted within the passage 19 and in abutment with a forward arresting edge 41 of the passage. A second helical spring 42 is retained captive but inside the first helical spring and in compression between a rear end 43 of the rod-like member valve 36 and the abutment wall 44 of the connecting cap 26. This spring 42 urges the head 38 of the second valve 36 in sealing engagement against the valve seat or annular ring 40. An O-ring seal 45 is provided about the annular ring 40 to prevent leakage of fluid thereabout and to retain the O-ring firmly in position.

As shown in FIG. 1, a second trigger lever 46 is also pivotally connected in a manner as will be described later and is coupled to the second valve 36 whereby to displace same against the pressure of the helical spring 42 whereby to displace the valve 36 to communicate the second orifice 33, or feed conduit 12, with the forward portion of the passage 29, as shown at 29' which is in communication with the outlet 17 of the barrel 15 so as to release the second liquid under pressure, through the spray nozzle 16.

As is readily apparent from FIGS. 1 and 3, the entire valve assembly including the valve couplings to the trigger levers is easy to disassemble for repair and maintenance by simply detaching the connecting cap 26 from the rear end of the barrel 15.

Figures 3A, 3B:
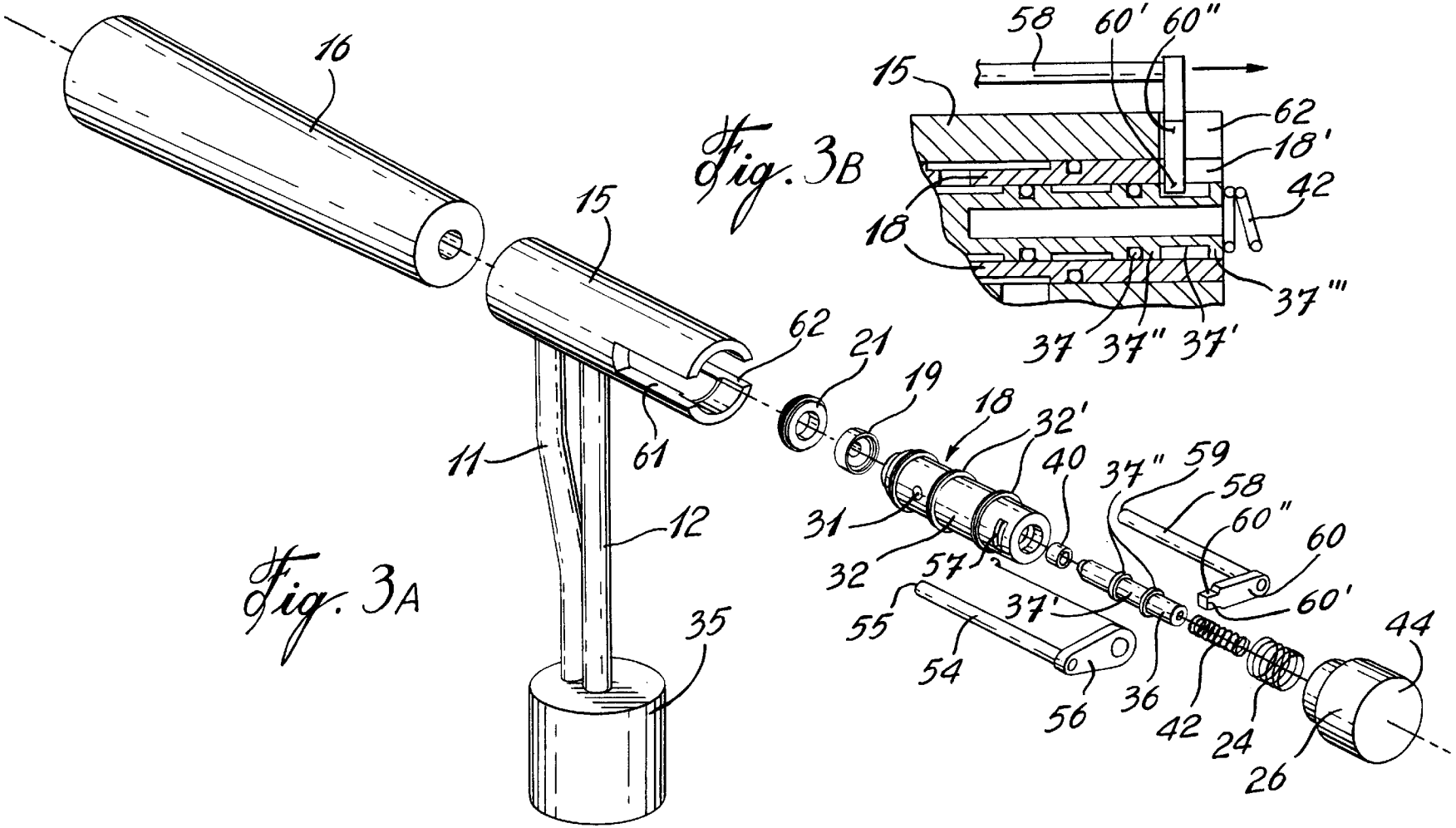
FIG. 3A is an exploded view showing the construction of the valves within the barrel and their lever coupling mechanism as well as the positioning of the barrel with respect to the spray nozzle.
FIG. 3B is a fragmented section view showing the connection of the coupling rod to the second rod-like valve.

As shown in FIG. 1, the first trigger lever 28 is pivotally secured at its pivot connection 50 between a pair of handle guard flanges 52 which extend on opposed sides and forwardly of the barrel 15. The second trigger lever 46 is pivotally mounted at pivot connection 51 to the upper part of the pivot trigger member 28. The first trigger member 28 has a finger grasping wall 53 which is engageable by the three lowermost fingers of the user's hand and it is biased outwardly, as shown in FIG. 1, through a coupling rod 54, as shown in FIG. 3A. The coupling rod 54 is engageable at a forward end 55 by the first trigger lever 28. The other end of the coupling rod is secured to a coupling member 56 which is removably connected within a connecting slot 57 formed in a side wall of the elongated cylindrical tubular member 18. The barrel 15 is provided with a slot 61 through which the coupling member 56 is displaced. Because the helical spring 34 urges the cylindrical tubular member 18 forwardly within the barrel 15, it likewise biases the first trigger lever forwardly away from the handle 13 through the rod 54.

As shown in FIGS. 3A and 3B, the second trigger lever 46 is coupled to a coupling rod 58 or abuts a forward end 59 thereof whereby to displace the second valve, herein the rod-like member 36, rearwardly within the passage 29 of the first valve tubular member 18 against the pressure of the spring 42. The connecting member 60 secures the rod 58 to the rod-like member 36 through a further slot 62 provided in the barrel 15.

As can be seen in FIG. 3B, the connecting member 60 has a connecting head 60' at an end thereof forwardly of a neck portion 60" which extends in sliding displacement in the slot 62. The tubular member forming the first valve also has a slot 18' formed in a rear end portion and sealed from the orifices 27 and 33. This slot 18' accommodates passage of the head 60' of the connecting member 60. The head 60' is positioned in the gap 37' between circumferential flanges 37" behind the seal 37. Accordingly, it can be seen that the second trigger lever 46 is forwardly biased by the helical spring 42 which pushes the rod-like member 36 forwardly within the bore or passage 29. The connecting member 60 follows the displacement of the rod-like member 36 as the helical spring 42 applies pressure against the connecting head 60' of the connecting member 60 which is coupled to the lever trigger 46.

Figure 4A:
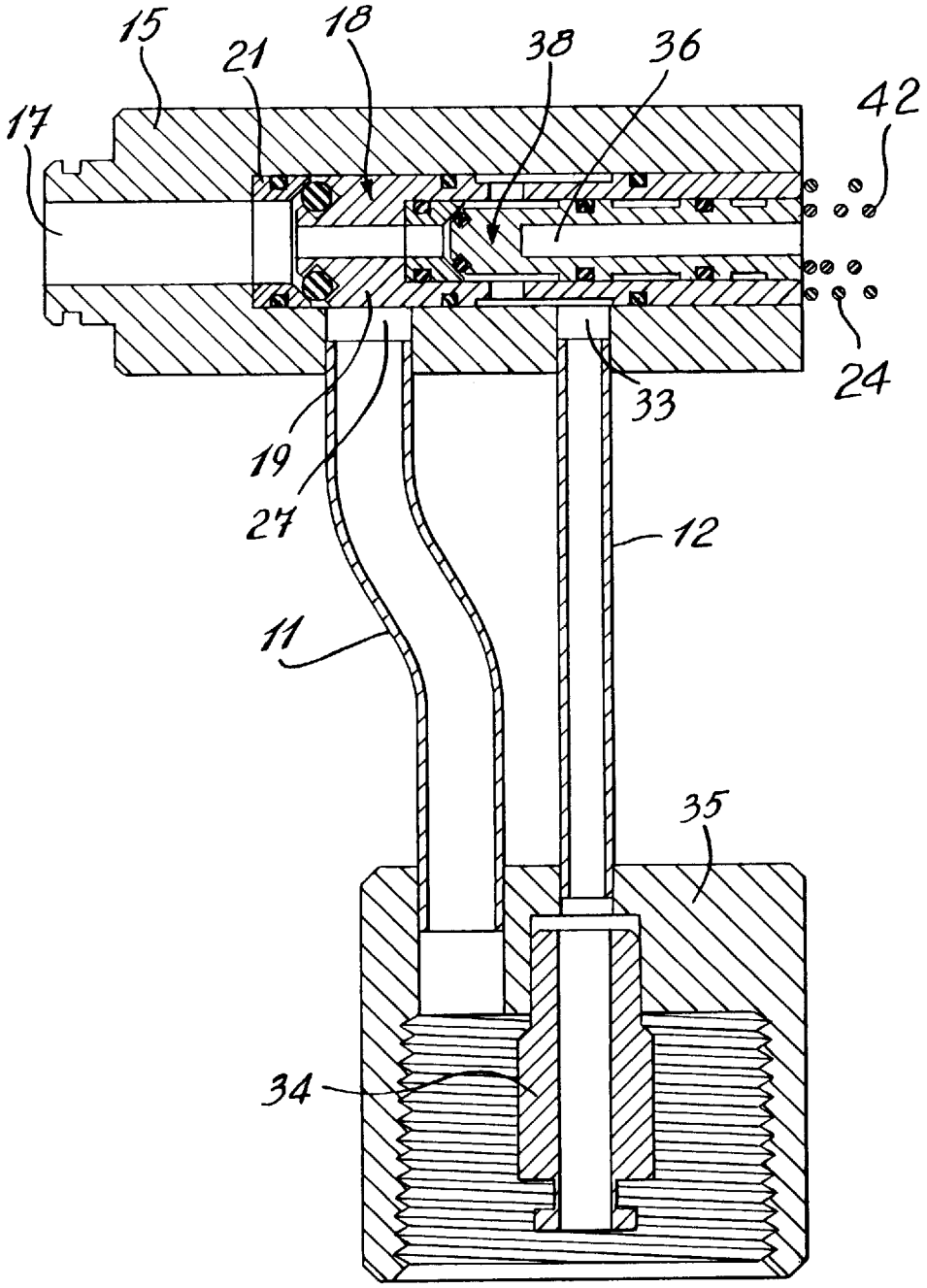
FIGS. 4A to 4C are section views showing the operation of the valves within the barrel.
Figure 4B:
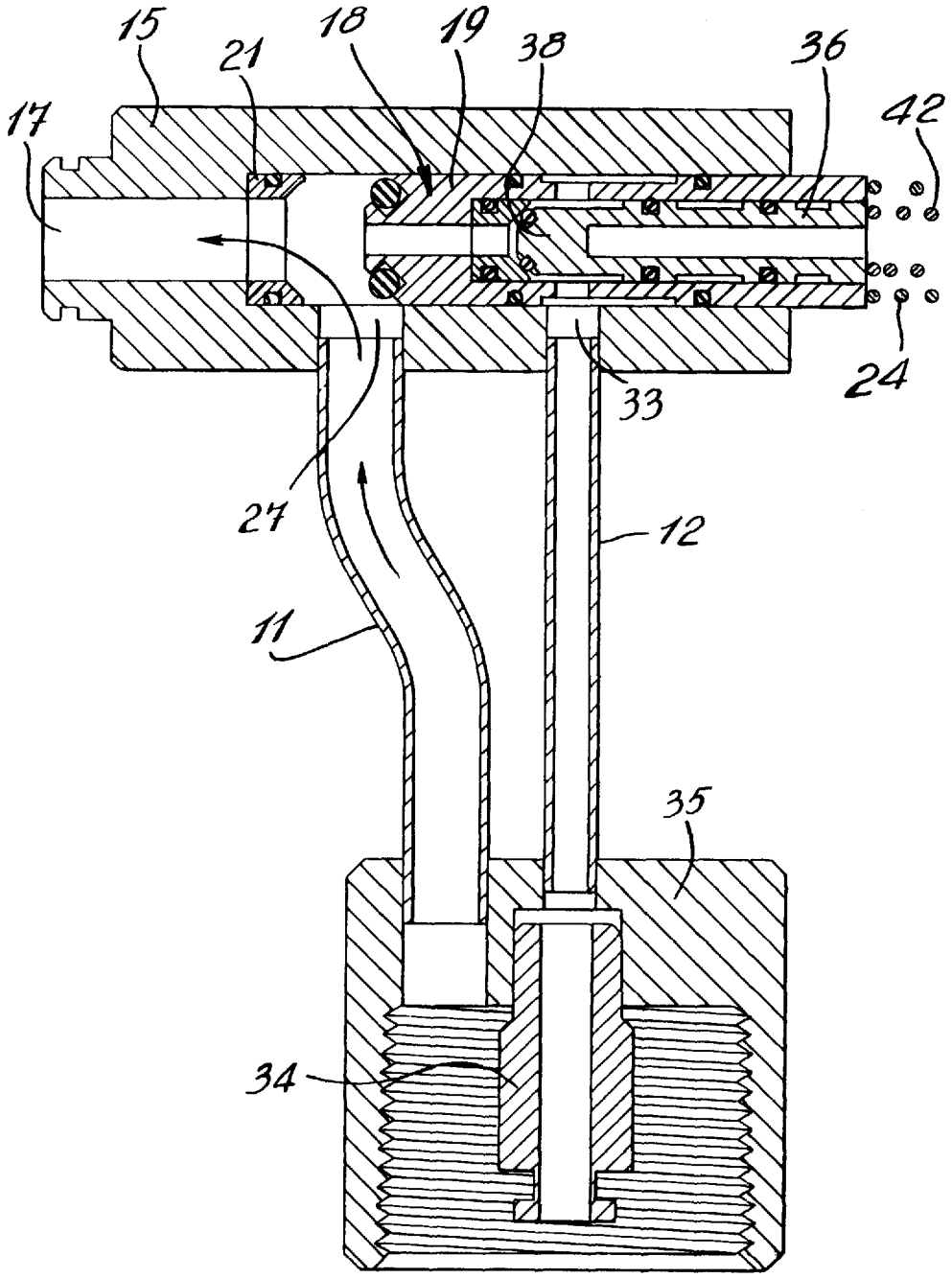
Figure 4C:
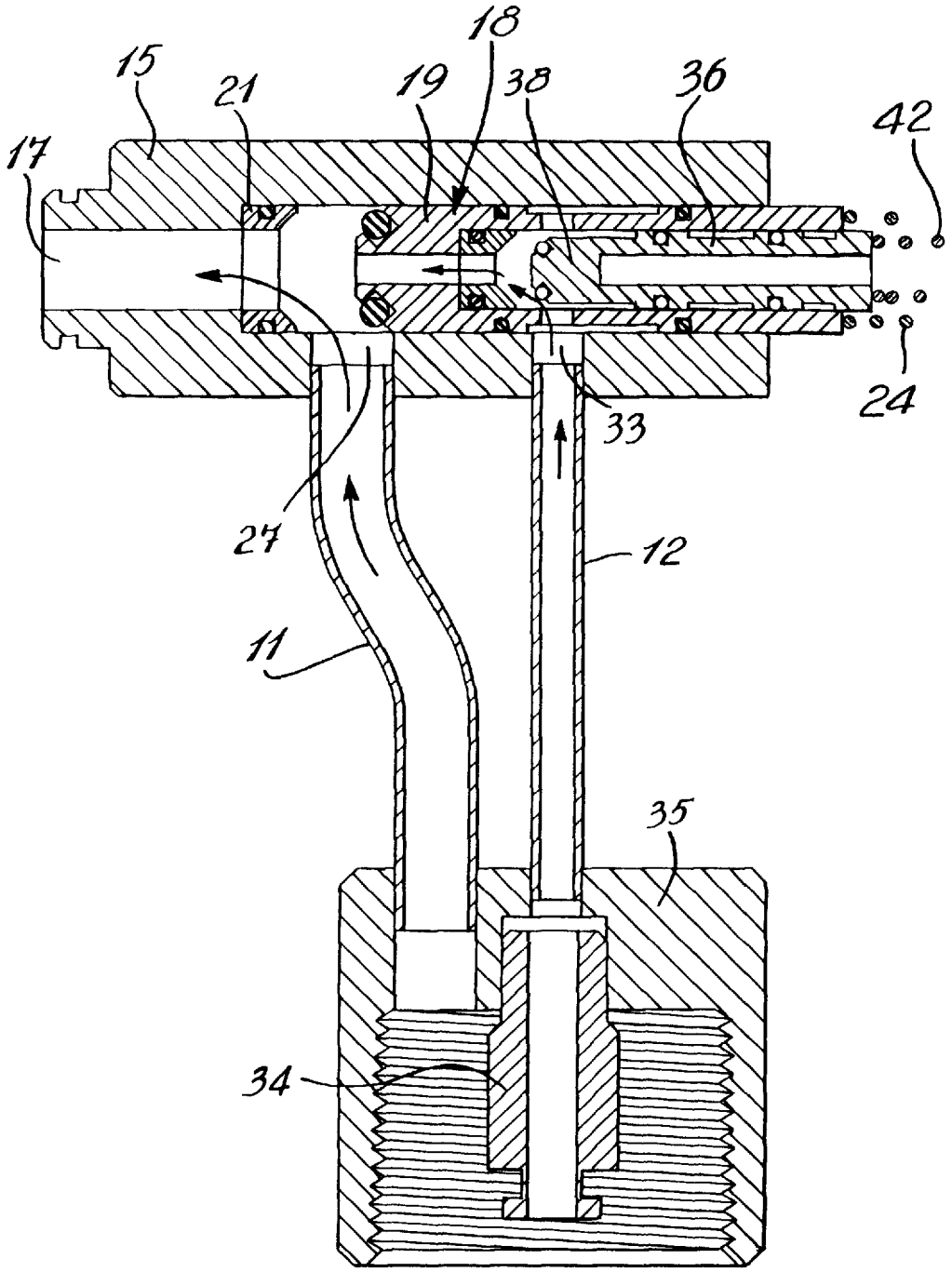

With reference now to FIGS. 1 and 4A to 4C, there will be described the operation of the spray gun 10 and its trigger levers. As shown in FIG. 1, the trigger lever 46 has an abutment flange 46' which is received in abutment overlapped relationship against a rear edge 53' of the finger grasping wall 53 of the first trigger lever 28 adjacent an opening 63 in a top portion thereof. As previously described both of these trigger levers 28 and 46 are biased forwardly by the springs 24 and 42 respectively, and accordingly when the trigger lever 28 is drawn rearwardly towards the forward edge 13' of the handle 13, it will also draw the trigger lever 46 inwardly, in the direction of arrows 70, due to its abutment with the flange 46'. This simultaneously pushes the coupling rods 54 and 58 rearwardly to a position as shown in FIG. 4B where the head 19' of the first valve 18 is withdrawn to communicate the orifice 27 with the outlet 17 of the barrel 15. During this retraction of the first valve 18, the second valve 36 is maintained biased within the passage 29 of the first valve with the head 38 thereof in sealing relationship with the annular ring 40. In this position, the pressurized fluid solution in communication with the conduit 11 is released through the spray nozzle 16 and the other orifice 33 is blocked. By maintaining the first trigger lever 28 against the forward edge 13' of the handle 13 and now pulling the second trigger lever 46 in the direction of arrow 70, the rod-like member 36 is withdrawn axially within the passage 29 and now communicates the fluid under pressure associated with the orifice 33 and the second conduit 12 with the outlet 17 and out through the spray nozzle 16 in admixture with the pressurized fluid in the first conduit 11.

If it is only desirable to release the fluid under pressure from the second conduit 12 through the spray nozzle and not the first conduit, then it is only necessary to actuate the trigger lever 46 with the index finger of the user's hand. This causes the coupling rod 58 to move rearwardly withdrawing the rod-like member 36 within the passage 29 of the cylindrical tubular member 18 against the spring force of spring 42 thereby communicating the second orifice 33 with the outlet 17 and the spray nozzle 16 thereby dispensing solely the liquid solution within the second conduit 12. The orifice 27 remains closed by the first valve 18.

In a particular application of the present invention, the spray gun is a gardening spray gun and dispenses through the conduits 11 and 12 a fertilizing liquid solution and a pesticide liquid solution, respectively, which are maintained under pressure in suitable reservoir means, not shown, but obvious to a person skilled in the art.

It is pointed out that it is within the ambit of the present invention to cover any obvious modifications of the example of the preferred embodiment described herein, provided such modifications fall within the scope of the appended claims.

We claim:

1. A spray gun for dispensing a first and second liquid under pressure independently from one another or both simultaneously to form a spray mixture, said spray gun comprising a barrel which forms part of a spray gun assembly, a spray nozzle in said assembly for receiving liquid from an outlet of said barrel and dispensing same in a jet spray, a handle in said assembly, a first valve sealingly displaceable in said barrel, first spring biasing means urging said first valve against a first valve seat to close a first feed conduit orifice communicating with said barrel, a first trigger lever coupled to said first valve to displace same against said first spring biasing means to open said first feed conduit orifice and communicate same with said barrel and said outlet of said barrel to release said first liquid under pressure through said spray nozzle, said first valve having passage means therein communicating with said outlet of said barrel, a second valve sealingly displaceable with respect to said passage means, second spring biasing means urging said second valve against a second valve seat to close a second feed conduit orifice communicating with said passage means, a second trigger lever coupled to said second valve to displace same against said second spring biasing means to communicate said second feed conduit orifice with said passage means and said outlet of said barrel to release said second liquid under pressure through said spray nozzle, said first and second trigger levers being pivotally secured forwardly of said handle for actuation by the fingers of a single hand of a user person.

2. A spray gun as claimed in claim 1 wherein said barrel is an elongated tubular barrel, said first valve being an elongated cylindrical tubular member sealingly displaceable inside said tubular barrel, said passage means being a cylindrical bore defined inside said cylindrical tubular member, said cylindrical tubular member having an opening therein coupling said second feed conduit orifice with said cylindrical bore, said second valve being a rod-like member axially displaceable in sealing engagement inside said cylindrical bore and sealing said second feed conduit orifice from said outlet of said barrel.

3. A spray gun as claimed in claim 2 wherein said first spring biasing means is a first helical spring retained captive and in compression between a rear end portion of said elongated cylindrical tubular member and an abutment wall of a rear connecting cap secured at a rear end of said barrel.

4. A spray gun as claimed in claim 3 wherein said second spring biasing means is a further helical spring retained captive inside said first helical spring and in compression between a rear end of said rod-like member and said abutment wall of said rear connecting cap.

5. A spray gun as claimed in claim 4 wherein said rear end connecting cap is a removable cap to permit access to said barrel to assemble and disassemble said valves.

6. A spray gun as claimed in claim 2 wherein said first trigger lever is pivotally connected in said assembly, said first trigger lever having a coupling rod coupled thereto and a coupling member secured to said elongated cylindrical tubular member through a connecting slot opening formed in said elongated tubular barrel rearwardly of said second feed conduit orifice, said first trigger lever being spring biased by said first spring biasing means through said coupling rod.

7. A spray gun as claimed in claim 6 wherein said second trigger lever is pivotally connected in said assembly, a further coupling rod coupled to said second trigger lever and to a further coupling member engageable with said rod-like member, said further coupling member being retained captive between a pair of spaced circumferential flanges formed about said rod-like member, said coupling member extending through a slot formed in said cylindrical tubular member, said second trigger lever being spring biased forwardly by said second spring biasing means through said further coupling rod.

8. A spray gun as claimed in claim 7 wherein said further coupling member has a head at a free end thereof, a neck is defined adjacent said head and held captive and in sliding displacement by said slot in said barrel.

9. A spray gun as claimed in claim 7 wherein said second trigger lever is biased outwardly of a forward wall of said first trigger lever and displaceable inside said forward wall to terminate substantially flush therewith when actuating said rod-like member.

10. A spray gun as claimed in claim 9 wherein said second trigger lever has an engageable flange in abutment with said forward wall of said first trigger lever, said first trigger lever being actuated simultaneously with said first trigger whereby both said first and second valves are displaced in unison with said second valve maintaining said second orifice obstructed as said first orifice is unobstructed.

11. A spray gun as claimed in claim 2 wherein said first and second feed conduit orifices each have a feed pipe connected thereto and extending through said handle to a coupling for securing same to a respective pressure supply source of said first and second liquid under pressure, respectively.

* * * * *